US007244471B2

(12) United States Patent
Takano et al.

(10) Patent No.: US 7,244,471 B2
(45) Date of Patent: Jul. 17, 2007

(54) METHOD FOR SURFACE TREATMENT OF METAL PIPES

(75) Inventors: Takahiro Takano, Wakayama (JP); Mituo Watanabe, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/995,187

(22) Filed: Nov. 24, 2004

(65) Prior Publication Data

US 2005/0147760 A1 Jul. 7, 2005

Related U.S. Application Data

(63) Continuation of application No. PCT/JP03/07190, filed on Jun. 6, 2003.

(30) Foreign Application Priority Data

Jun. 6, 2002 (JP) ..... 2002-166162

(51) Int. Cl.
*B05D 5/00* (2006.01)

(52) U.S. Cl. ..... 427/421.1; 427/427.5; 427/233; 427/236; 427/234; 239/595; 239/38; 239/101; 239/41; 239/40; 239/37; 239/570; 134/54; 117/72

(58) Field of Classification Search ..... 239/595, 239/38, 101, 41, 40, 37, DIG. 14, DIG. 1, 239/570; 118/DIG. 11, DIG. 13; 117/72; 427/236, 234, 427.5, 233, 421.1; 134/54
See application file for complete search history.

(56) References Cited

U.S. PATENT DOCUMENTS 1,829,831 A * 11/1931 Hiskey ..... 118/307
4,380,319 A * 4/1983 Shigut ..... 239/540
4,600,601 A 7/1986 Tamura
4,900,593 A 2/1990 Krippl

FOREIGN PATENT DOCUMENTS

| | | |
|---|---|---|
| GB | 1392884 | 5/1975 |
| JP | 43-29465 | 12/1968 |
| JP | 57-170844 | 10/1982 |
| JP | 1-202818 | 8/1989 |
| JP | 08246162 A * | 9/1996 |
| JP | 2660689 | 6/1997 |
| JP | 11-217240 | 8/1999 |
| JP | 2988310 | 10/1999 |
| JP | 2002-080976 | 3/2002 |

* cited by examiner

*Primary Examiner*—Alain L. Bashore
(74) *Attorney, Agent, or Firm*—Clark & Brody

(57) ABSTRACT

A method and apparatus for surface treating metal pipes includes introducing a treatment liquid into a first distribution chamber having a flat bottom surface, and dropping the treatment liquid onto at least a portion of the outer peripheral surface of the metal pipe through a plurality of holes formed in the bottom surface of the first distribution chamber. Preferably, a distance between the bottom surface of the first distribution chamber and the metal pipe is maintained constant as the outer diameter of the pipe varies. The treatment liquid may be introduced into a second distribution chamber having a flat bottom surface, and the treatment liquid may then be introduced into the first distribution chamber through a plurality of holes formed in the bottom surface of the second distribution chamber. It is possible for the first distribution chamber to simultaneously drop the treatment liquid onto at least two metal pipes.

16 Claims, 4 Drawing Sheets

PRIOR ART PRIOR ART

METHOD FOR SURFACE TREATMENT OF METAL PIPES

This application is a continuation of International Patent Application No. PCT/JP03/07190, filed Jun. 6, 2003. This PCT application was not in English as published under PCT Article 21(2).

TECHNICAL FIELD

This invention relates to a method and apparatus for performing surface treatment, and particularly chemical conversion treatment such as phosphate treatment (phosphating) of at least a portion of the outer peripheral surface of a metal pipe, such as a threaded connecting portion having an external thread formed on one or both ends of an oil well pipe.

BACKGROUND ART

Oil well pipes are commonly connected to each other by pin-box type threaded joints comprising a pin having an external thread and a box having an internal thread. Pin-box type threaded joints can be classified as coupling types and direct connection types.

In coupling-type threaded joints, normally, both ends of an oil well pipe have a pin comprising an external thread formed thereon. The pin of an oil well pipe can be connected to the pin of another oil well pipe by a coupling, which is a separate member having an internally-threaded box formed thereon.

In direct connection type threaded joints, a pin having an external thread is formed on one end of an oil well pipe, and a box having an internal thread is formed on the other end. Two oil well pipes are connected to each other by screwing the pin of one pipe into the box of the other pipe and tightening the joint.

In order to improve the sealing properties of a threaded joint, in recent years, a special threaded joint having an unthreaded metal contact portion which adjoins a threaded portion and which can form a metal-to-metal seal has come to be used.

In general, when a threaded joint is tightened, in order to reduce friction, a lubricating oil is applied to a portion of the joint. In particular, with threaded joints having an unthreaded metal contract portion to which it is necessary to apply an extremely high surface pressure in order to guarantee sealing properties, it is customary to apply to the joint a lubricating grease which is viscous at room temperature in order to prevent galling, which is unrepairable seizing.

In order to increase the retention of a lubricating oil or a lubricating grease, a threaded joint is frequently subjected to phosphate treatment with manganese phosphate, zinc phosphate, or similar material. The crystalline phosphate coating which is formed is porous and has numerous pores, so it can retain a lubricating oil or grease in its pores. When pressure is applied to a threaded joint during tightening, the phosphate coating is compressed to cause the lubricating oil or grease retained in its pores to be released out of the coating. Accordingly, by forming a phosphate coating on the surface of a threaded joint, the rust-preventing properties and lubricity of a lubricating oil or grease are greatly improved.

This effect can be obtained by forming a phosphate coating on the surface of either the pin or the box of a threaded joint and applying a lubricating oil or grease to the coating. It is desirable that the phosphate coating be formed with a uniform thickness (or coating weight). If there are variations in the thickness of a phosphate coating, the amount of lubricating oil or grease which is retained by the phosphate coating varies. As a result, in locations where the phosphate coating is thin, galling may occur due to insufficient lubricity (galling occurring particularly readily in unthreaded metal contact portions).

Methods commonly used for performing surface treatment such as phosphate treatment of threaded joints formed on the ends of steel pipes such as oil well pipes include the immersion method and the dropping method. In the immersion method, as schematically illustrated in FIG. 7, surface treatment is carried out by disposing a steel pipe 3 in a tilted state with a threaded portion formed on one of its ends immersed in a treatment liquid 2 contained in a tank 1. In the dropping method, as schematically illustrated in FIGS. 8(*a*) and 8(*b*), a treatment liquid 2 in a tank (not shown) is passed through a supply pipe 5 and is sprayed or dripped from nozzles 4 onto a threaded portion 3*a* on the end of a steel pipe 3.

The immersion method requires a large installation space, and it is necessary to lift and lower a steel pipe being treated, so its working efficiency is poor. In addition, when performing surface treatment only of the exterior surface of the end of a steel pipe, it is necessary to close the open end of the pipe to prevent the treatment liquid from entering its interior, or it is necessary to perform treatment to prevent the treatment liquid from adhering to the interior of the pipe, so the method becomes complicated to perform.

In the dropping method, as shown in FIGS. 8(*a*) and 8(*b*), a plurality of steel pipes can simultaneously undergo continuous surface treatment by arranging the pipes in parallel and spraying a treatment liquid from a plurality of nozzles onto the pipes as the pipes are being conveyed, so surface treatment can be efficiently performed in a smaller space.

Phosphate treatment is preceded by pretreatment including degreasing and subsequent water rinsing, and followed by post-treatment including rinsing with cold and/or warm water to remove excess treatment liquid. In order to efficiently carry out phosphate treatment including this pretreatment and post-treatment by the dropping method, Japanese Patent No. 2,988,310 discloses an apparatus in which the ends of steel pipes are successively passed beneath nozzles which supply liquids for each step as the steel pipes are conveyed at a constant speed in a direction perpendicular to the pipe axes while being rotated. Different treatment areas are partitioned from each other by curtains in order to prevent the liquids which are dropped in each step from mixing with each other.

In the dropping method, when a treatment liquid is sprayed from nozzles as shown in FIGS. 8(*a*) and 8(*b*), the treatment liquid spreads out in a conical shape, so the closer the nozzles are to the steel pipes being treated, the easier it is for the amount of the treatment liquid which is sprayed onto the pipe surface to become nonuniform. As a result, in the case of phosphate treatment, variations develop in the thickness of the phosphate coating which is formed, and "lack of hiding", which is a condition in which the bare metal of the steel pipe is visible, can easily occur in portions where the coating thickness is low. In addition, when the supply pipe 5 and the nozzles 4 are arranged in one row as shown in the figures, the area of treatment measured in the axial direction of the steel pipes varies in accordance with the separation (distance) between the nozzles and the steel pipes. Therefore, if the nozzles are too close to the steel pipes, in order to form a phosphate coating over a desired region in the axial direction of the pipes, it becomes necessary to take steps such as providing supply pipes and nozzles in two rows, and the treatment apparatus becomes complicated.

Phosphate treatment is usually carried out at a temperature higher than room temperature in order to promote the reaction on the surface of the steel pipe. In the case of the dropping method, a phosphate treatment liquid (a phosphating solution) which is heated in a tank to a temperature of 70±5° C. is passed through the supply pipe and sprayed from the nozzles, whereby phosphate treatment is performed at a temperature above room temperature. If the temperature of the phosphating solution on the surface of the steel pipe changes, the coating weight and the crystallinity of the resulting phosphate coating also change.

The treatment liquid which is sprayed from the nozzles decreases in temperature due to contact with the atmosphere which is at a cooler temperature. When sprayed from the nozzles, the treatment liquid is formed into fine droplets, and its surface area is increased, so it undergoes a large decrease in temperature at this time. Therefore, when the diameter of the steel pipe being treated varies, the distance between the nozzles and the steel pipe also varies, and the extent of decrease in the temperature of the treatment liquid varies. Thus, in the case of phosphating, the temperature of the phosphating solution when it reaches the surface of the steel pipe varies, and as a result, a phosphate coating having a desired coating weight and crystallinity may not be formed. Similarly, when the distance between the nozzles and the steel pipe is increased in order to increase the length in the axial direction of the pipe over which treatment is performed, the extent of decrease in temperature also increases, and a phosphate coating having a desired coating weight and crystallinity may not be formed.

If the temperature of the phosphating solution in the tank is increased in order to compensate for the above-described decrease in temperature by spraying, the phosphating solution becomes overheated, leading to the formation of precipitates (sludge). As a result, active ingredients of the phosphating solution are consumed as sludge, resulting in increased costs of the solution.

Thus, particularly in the dropping method in which a phosphating solution is sprayed from nozzles, it was difficult to suitably control the temperature of the solution when it contacted the surface of a steel pipe. As a result, the coating weight or the crystallinity of the phosphate coating which was formed were inadequate, or the coating weight was not uniform, and when a lubricating oil or grease was applied to it, the above-described problems developed.

As a solution to cope with these problems, Japanese Patent No. 2,660,689 discloses a method in which a phosphating solution is allowed to naturally fall by overflowing as a laminar flow from a current plate provided in a tank and contact the surface of rotating steel pipes.

However, in that method, it is not possible to simultaneously treat a plurality of steel pipes using a single tank, so it has a lower treatment efficiency than treatment by the method shown in FIGS. 8(*a*) and 8(*b*) in which a plurality of steel pipes can be simultaneously treated by spraying from nozzles. Furthermore, the position of the tank is fixed, so depending upon the outer diameter of the pipe being treated, the distance between the tank and the pipe increases, the temperature of the phosphating solution decreases, and the coating weight of the phosphate coating decreases. Furthermore, in that method, it is mandatory to rotate the steel pipes while dropping a phosphating solution thereon.

SUMMARY OF THE INVENTION

This invention provides a method for surface treatment of at least a portion of the outer peripheral surface of a metal pipe, as represented by phosphate treatment by the dropping method of a threaded connecting portion formed on the end of a steel pipe. The method can uniformly drop a treatment liquid on a pipe surface, with a smaller decrease in temperature compared to a method in which a treatment liquid is sprayed from nozzles, and can eliminate variations in the decrease in temperature of treatment liquid due to variations in the diameter of pipes being treated. A method according to the present invention can efficiently form a phosphate coating having a sufficient and uniform thickness on a threaded connecting portion on the end of a steel pipe for use as an oil well pipe.

According to one form of the present invention, there is provided a surface treatment method for metal pipes comprising introducing a treatment solution into a first distribution chamber having a flat bottom surface, and then dropping the treatment liquid onto at least a portion of an outer peripheral surface of a metal pipe through holes formed in the bottom surface of the first distribution chamber.

In this form of the invention, the distance between the bottom surface of the first distribution chamber and the metal pipe is preferably maintained constant as the outer diameter of the pipe varies. It is also possible for the treatment liquid to be introduced into a second distribution chamber having a flat bottom surface and to be introduced into the first distribution chamber through a plurality of holes formed in the bottom surface of the second distribution chamber. The first distribution chamber can preferably simultaneously drop the treatment liquid onto at least two metal pipes being treated.

According to another form of the present invention, an apparatus for performing surface treatment with a treatment liquid of at least a portion of the outer peripheral surface of a metal pipe includes a supply pipe for a treatment liquid having one or more nozzles mounted thereon, a first distribution chamber disposed is beneath the nozzles and having a flat bottom surface which has a plurality of holes through which the treatment liquid can be dropped onto the metal pipe, and a support mechanism which supports a metal pipe so that the portion of the metal pipe to undergo surface treatment is positioned beneath the first distribution chamber.

At least one second distribution chamber having a flat bottom surface and having a plurality of holes in the bottom surface through which the treatment liquid can be dropped may be provided between the nozzles and the first distribution chamber, and the treatment liquid can be introduced from the nozzles into the second distribution chamber and then from the second distribution chamber into the first distribution chamber. The first distribution chamber and/or the nozzles can preferably be raised and lowered with respect to the metal pipe. The support mechanism can preferably transport one or more metal pipes in a direction perpendicular to the pipe axes.

BEST MODE FOR CARRYING OUT THE INVENTION

This invention relates to a method and apparatus for surface treatment of at least a portion of the outer peripheral surface of a metal pipe. The portion of the pipe to be surface treated can be at any desired position in the axial direction of the pipe, but typically it is an end portion of the pipe. The method and apparatus according to the present invention are also applicable to surface treatment of the entire outer peripheral surface of a metal pipe.

There is no particular restriction as to the type of metal pipe to be treated or the material of which the metal pipe is made, and the present invention can be applied to any desired type of metal pipe on which surface treatment, and particularly chemical conversion treatment requiring a chemical reaction, can be performed on at least a portion of its outer peripheral surface. The metal pipe is typically a steel pipe, and particularly a steel pipe, such as an oil well pipe, having a threaded connecting portion formed on one or both of its ends.

The surface treatment is not limited to chemical conversion treatment, but preferably it is chemical conversion treatment in which a reaction is preferably performed at a constant temperature higher than room temperature, such as phosphate treatment (phosphating) including manganese phosphating and zinc phosphating. The treatment liquid used for the surface treatment is not limited to a solution.

Below, the present invention will be explained while referring to the accompanying drawings for the case in which a threaded connecting portion formed on an end of a steel pipe for use as an oil well pipe is treated by phosphate treatment. However, as stated above, the surface treatment method and apparatus according to the present invention are not restricted to the illustrated type of treatment.

In the present invention, at least a portion of the outer peripheral surface of a steel pipe undergoes surface treatment. Accordingly, the threaded connecting portion on the end of a steel pipe being treated is a pin having an external thread. The threaded connecting portion may be either (1) one having only a threaded portion as a metal contact portion, or (2) one having a threaded portion and an unthreaded metal contact portion which can form a metal-to-metal seal. In either case, a phosphate coating is preferably formed on the entire metal contact portion, i.e, on the threaded portion in case (1), and on both the threaded portion and the unthreaded metal contact portion in case (2). However, it is also possible to form a phosphate coating on only a portion of the metal contact portion. For example, in case (2), a considerable degree of improvement in anti-galling properties can be obtained by performing phosphate treatment only on the unthreaded metal contact portion, which is more susceptible to galling than the threaded portion thereof.

Figure 1:
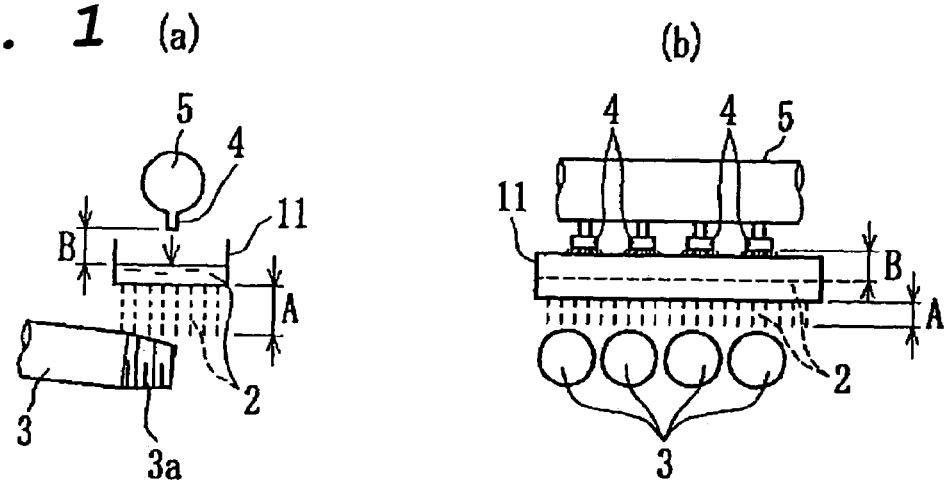
FIG. 1(*a*) is a schematic side elevation and FIG. 1(*b*) is a schematic front elevation of external threads on the ends of pipes undergoing surface treatment by a surface treatment method according to the present invention.

As shown in FIG. 1(*a*), a phosphating solution 2 which is heated to a prescribed temperature in a tank or in a suitable heating mechanism is transported by a pump through a supply pipe 5 and is introduced into a first distribution chamber 11 through one or more nozzles 4 mounted on the lower portion of the supply pipe 5. The phosphating solution 2 in the first distribution chamber 11 is dropped onto a threaded portion 3*a* on the end of a steel pipe 3 through a plurality of holes formed in the flat bottom surface of the chamber 11. Thus, the phosphating solution 2 flows naturally downwards through each hole of the chamber to form a continuous flow in a laminar flow state, in contrast to the conventional method illustrated in FIGS. 8(*a*), 8(*b*) in which the solution is dropped in the form of discrete droplets. Accordingly, unlike the conventional method, the solution does not spread in a conical shape, so the length in an axial direction of the pipe portion being treated does not vary even if the distance between the bottom surface of the distribution chamber and the steel pipe changes. The first distribution chamber 11 can be a shallow rectangular box which is open at its upper end.

Instead of being directly sprayed from the nozzles, the phosphating solution is first received and accumulated in the flat box-shaped first distribution chamber 11 and then allows to flow downwards in laminar flow through the holes formed in the wide bottom surface of the first distribution chamber 11, so the large area of the outer surface of the pipe can be uniformly subjected to phosphate treatment, and a uniform phosphate coating can be efficiently formed.

As shown in FIG. 1(*b*), the dimension of the first distribution chamber 11 (more precisely, the dimension of the portion of the bottom surface in which the holes are provided) in the direction perpendicular to the axes of the pipe being treated [the length of the first distribution chamber 11 in FIG. 1(*b*)] is preferably such that the phosphating solution can simultaneously be dropped onto a plurality of pipes (four pipes in the illustrated example). As a result, the efficiency or productivity of phosphate treatment can be enormously increased. For example, the dimension may be made large enough to enable ten or more pipes to be simultaneously treated. Although not shown, a recovery vessel (preferably one having a bottom surface somewhat larger than the first distribution chamber 11) is disposed below the pipes 3 in order to recover the phosphating solution which does not adhere to the pipes. The recovered phosphating solution can be reused after treated for regeneration, if necessary.

When the first distribution chamber 11 is used to treat a single steel pipe, the dimension of the first distribution chamber 11 in the direction perpendicular to the pipe axis is preferably greater than or equal to the outer diameter of the largest pipe to be treated. However, even if this dimension is smaller than the outer diameter, the phosphating solution which is dropped onto a pipe flows along the outer surface of the pipe in the circumferential direction thereof, so it can adhere to the pipe over its entire circumference. Accordingly, there are no particular restrictions on the dimension of the first distribution chamber 11 in the direction perpendicular to the pipe axis.

The dimension of the first distribution chamber 11 in the axial direction of a pipe being treated [the length of the first distribution chamber in FIG. 1(*a*)] is preferably at least the length in the axial direction of the portion of the pipe which is to be treated. However, also with respect to this dimension of the chamber in the axial direction, when the portion of the pipe to be treated is sloped with respect to the horizontal as shown in FIG. 1(*a*), the phosphating solution flows over the surface of the pipe not only in the circumferential direction but also in the axial direction of the pipe, so the dimension of the first distribution chamber 11 in the axial direction of the pipe may be smaller than the length of the portion to be treated. However, when treating a threaded portion, the thread makes the phosphating solution difficult to flow in the axial direction of the pipe, so in this case, the dimension of the first distribution chamber 11 in the axial direction is preferably at least as great as the length of the portion of the pipe to be treated.

Although the drawings show only a single first distribution chamber 11, it is possible to employ a plurality thereof For example, when the dimensions of the region over which it is desired to drop a phosphating solution measured in the axial direction and/or the direction perpendicular to the axes of the pipes being treated are very large (such as when surface treatment is to be performed over the entire length of each pipe), or when two or more portions of a steel pipe which are separate in the axial direction are subjected to surface treatment, a plurality of similar first distribution chambers 11 may be provided, each disposed over a different portion of the pipes to be treated.

When performing surface treatment of the end of a pipe, as shown in FIG. 1(*a*), the pipe may be sloped slightly towards the end which is to be treated, in order to prevent the phosphating solution from flowing into the interior of the pipe through its open end. However, if the slope is too great, particularly when the pipe is being rotated during treatment, the pipe may slip down in its axial direction, and it becomes difficult to perform treatment which is uniform in the axial direction of the pipe.

When performing surface treatment of a portion of a pipe other than an end portion thereof, the pipe is preferably maintained horizontal. In this case, it is preferable to provide a mechanism for preventing the phosphating solution from spreading along the surface of the pipe in the axial direction of the pipe (such as a dam or protective tape which repels the phosphating solution applied to the pipe).

Steel pipes to be treated are supported by a support mechanism so that the end portion of the pipe is positioned beneath the first distribution chamber 11. Preferably, the steel pipes are transported by a suitable transport mechanism while arranged in a row parallel to each other so that the end portions of the pipes successively pass beneath the first distribution chamber 11. The transport speed is selected so that the phosphating solution is dropped onto each pipe for a desired treatment time. Accordingly, the larger the dimension of the first distribution chamber 11 in the direction perpendicular to the pipe axes (i.e., the larger the number of pipes which can be simultaneously treated), the higher can be the transport speed, and the higher can be the operating efficiency. When an adequate treatment time cannot be guaranteed with a constant transport speed, the pipes can be intermittently transported, and a pipe can be stopped beneath the first distribution chamber 11 for a prescribed period of time.

The pipes to be treated can be transported by, for example, a chain-driven pipe transport apparatus like that disclosed in Japanese Patent No. 2,988,310, which comprises a skid which supports a plurality of pipes for movement along a path and projections for holding the pipes, which projections extend above the upper surface of the skid and are arranged at prescribed intervals. As also disclosed in that patent, mechanisms for pretreatment such as degreasing and washing and for post-treatment such as washing with warm or cold water can be installed before and after a region for performing phosphate treatment.

The apparatus described in that patent is designed such that the pipes being treated are rotated while transporting them. In the present invention, rotation of the pipes being treated is optional, and even if the pipes are not rotated, the phosphating solution can be adhered to the lower portions of the pipes by natural flow of the phosphating solution along the outer peripheral surfaces of the pipes. However, rotation of the pipes being treated enables more uniform adhesion of the phosphating solution. When the pipes are not rotated during treatment, the transport apparatus disclosed in the above-mentioned Japanese patent should be modified so as not to rotate the pipes.

When the pipes are rotated during treatment, the axes of the pipes are preferably maintained horizontal. If a pipe being treated is rotated while sloped as shown in FIG. 1(*a*), the pipe gradually moves downwards in its axial direction due to its own weight, and operation becomes difficult. When rotation is carried out, the rotational speed is most preferably such that the pipe undergoes one rotation during treatment (namely, during the time in which it passes beneath the first distribution chamber 11). If the rotational speed is too high, the phosphating solution may be thrown off the pipe by centrifugal force, resulting in a decrease in the coating weight of the phosphating solution. As shown in FIG. 1(*a*), the threaded connecting portion of a pipe becomes narrower towards the end of the pipe, so even if the pipe is maintained horizontal, the phosphating solution will not spread from the threaded connecting portion in the direction away from the end of the pipe. In this case, the phosphating solution flows hardly into the interior of the pipe through its open end, but if necessary, a stopper or similar member may be installed on the end of the pipe to prevent the inflow of the phosphating solution.

The portion of the pipe undergoing phosphate treatment preferably does not contact the transport mechanism during treatment. When treating the end of a pipe, the pipe may be mounted on the transport mechanism so that the end of the pipe projects outwards from the transport mechanism. When treating a portion other than the end of the pipe, the transport mechanism can be designed so as to support portions of the pipe other than the portion being treated.

As shown in FIG. 1(*b*), when the dimension of the first distribution chamber 11 in the direction perpendicular to the axes of the pipes being treated is made large enough for a plurality of pipes to be simultaneously treated, the supply pipe 5 can be disposed above approximately the centerline of the first distribution chamber 11 in the direction perpendicular to the axes of the pipes, and a plurality of nozzles 4 can be arranged at equal intervals on the supply pipe 5 so that the phosphating solution 2 can be uniformly introduced into the distribution chamber 11 from one end to the other end in the direction perpendicular to the axes of the pipes. The nozzles may have holes or slits of a suitable size formed in their bottom portions.

The flow rate of a phosphating solution 2 from the nozzles 4 into the first distribution chamber 11 can be adjusted by a pump connected to the supply pipe 5. Alternatively, flow rate adjusting mechanisms can be provided on the nozzles 4 to adjust the flow rate of the phosphating solution 2. The flow rate is preferably adjusted so that the phosphating solution 2 accumulates within the first distribution chamber 11 to a depth of 10-20 mm.

In the method according to the present invention, the phosphating solution 2 contacts the atmosphere at least two times (once as it is introduced from the nozzles 4 into the first distribution chamber 11 and again as it is dropped from the first distribution chamber 11 onto the surface of a pipe being treated). During these periods of contact, its temperature decreases. However, as described below, by moving the distribution chamber 11 and the nozzles 4, the decrease in temperature can be minimized and/or maintained constant.

As described in Japanese Patent No. 2,988,310, when phosphate treatment is performed while transporting a row of parallel pipes on a skid, the outer diameter of the pipes being treated may vary, so it is necessary to position the supply pipe 5 with the nozzles 4 and the first distribution chamber 11 sufficiently high so that the pipes of the largest diameter can pass beneath them. In this case, when the treatment apparatus is treating pipes having a small outer diameter, the separation (distance) between the bottom surface of the first distribution chamber 11 and the pipes 3 being treated increases. For example, if the outer diameter of the largest pipes being treated is 508 mm and the outer diameter of the smallest pipes is 177.8 mm, the difference between the heights of the tops of the largest and smallest pipes is 330.2 mm, and the above-described distance from the bottom surface of the first distribution chamber 11 varies by the same amount. As a result, the amount of decrease in the temperature of the phosphating solution during the length of time until the solution which is dropped from the first distribution chamber 11 contacts a pipe being treated varies enormously. In addition, the flow speed of the solution increases due to the acceleration by gravity as the distance increases, so the flow speed of the solution when it contacts a pipe being treated also varies. As a result, the coating weight and the crystallinity of the phosphate coating which is formed vary, and there are cases in which a phosphate coating having a desired coating weight and/or crystallinity cannot be obtained.

Figure 2:
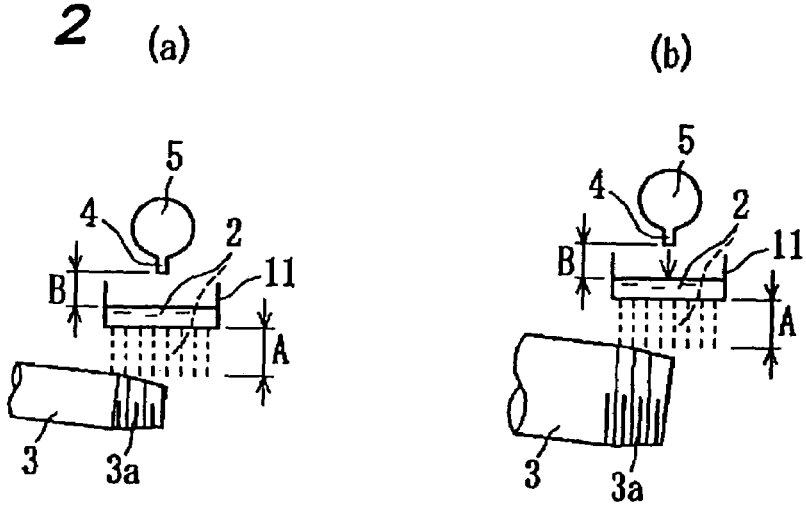
FIGS. 2(*a*) and 2(*b*) are schematic side elevations of a small-diameter pipe and a large-diameter pipe, respectively, undergoing surface treatment by a preferred embodiment of a surface treatment method according to the present invention.

In a preferred mode of the present invention, the distance A between the bottom surface of the first distribution chamber 11 and the pipes 3 being treated [the is distance between the bottom surface of the first distribution chamber 11 and the tops of the pipes being treated as shown in FIGS. 2(*a*) and 2(*b*)] is maintained constant (at 50 mm, for example) even when the outer diameter of the pipes being treated varies. This may be achieved by raising or lowering (i.e., moving in the Vertical direction) the pipes 3, but when the pipes are transported while mounted on a skid, it is preferable to maintain the distance A constant by moving the first distribution chamber 11 in the vertical direction to vary its height. The distance A is preferably 5-100 mm, particularly when performing phosphate treatment. If the distance A is smaller than 5 mm, oscillation of the pipes during transport may cause them to contact the first distribution chamber 11. If the distance A is larger than 100 mm, the drop in the temperature of the phosphating solution as it falls becomes large, and the coating weight of the phosphate coating may decrease. The distance A is more preferably 10-75 mm.

The distance A may have a certain tolerance so as to form a phosphate coating having a coating weight and crystallinity within a prescribed range. For example, the first distribution chamber 11 may not be moved in the vertical direction as long as the variation in outer diameter of the pipes is at most 20 mm.

If only the first distribution chamber 11 is moved in the vertical direction, the distance B between the upper surface of the solution in the first distribution chamber 11 and the lower surfaces (the tips) of the nozzles 4 will vary by the amount of movement of the distribution chamber 11, and the decrease in the temperature of the phosphating solution over this distance will correspondingly vary. More preferably, in order to also maintain the temperature drop over distance B constant, the distance B between the top surface of the phosphating solution in the first distribution chamber 11 and the lower surfaces of the nozzles 4 is maintained constant. This can be accomplished by moving the supply pipe 5, on which the nozzles 4 are mounted, in the vertical direction while moving the first distribution chamber 11 by the same distance and in the same direction. Distance B is preferably as small as possible, and normally it is preferably in the range of 5-100 mm.

The vertical moving of the first distribution chamber 11 and the supply pipe 5 can be performed using a well-known mechanism. When the pipes being treated are continuously transported while successively undergoing phosphate treatment, if the outer diameter of the pipes being treated changes, treatment can be momentarily stopped, the heights of the first distribution chamber 11 and the supply pipe 5 can be adjusted to maintain the distances A and B at prescribed values, and then treatment can be continued.

In this manner, by maintaining distances A and B constant and thereby maintaining the change in the temperature of the phosphating solution during dropping and the flow speed of the phosphating solution when it contacts the pipes being treated constant, phosphate treatment can be performed under constant conditions even if the outer diameter of the pipes being treated varies. As a result, an increase in the flow speed or an increase in the drop in temperature of the phosphating solution due to the distance becoming too large can be prevented, and a phosphate coating having an adequate thickness and crystallinity can be formed efficiently and with certainty.

Figure 3:
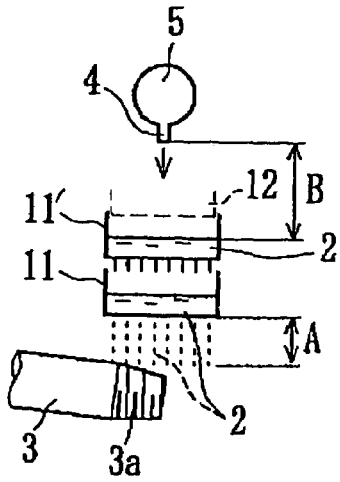
FIG. 3 is a schematic side elevation of a pipe undergoing surface treatment by another embodiment of a treatment method according to the present invention using a plurality of distribution chambers disposed at different levels.

In order to further decrease unevenness of the phosphating solution 2 which is dropped from the first distribution chamber 11, as shown in FIG. 3, one or more second distribution chamber 11' may be installed immediately above the first distribution chamber 11 (namely, between the first distribution chamber 11 and the nozzles 4). Each second distribution chamber 11' also has a flat bottom surface with a plurality number of holes formed therethrough.

In this case, a phosphating solution 2 is introduced from the supply pipe 5 through the nozzles 4 into the second distribution chamber 11'. After accumulating there, it is introduced through the holes in the bottom surface of the second distribution chamber 11' into the first distribution chamber 11, and then it is dropped from the holes in the bottom surface of the first distribution chamber 11 onto the pipes being treated. The greater the number of second distribution chambers 11', the smaller the unevenness of treatment. However, as the-number of second distribution chambers 11' increases, the greater the drop in the temperature of the phosphating solution, so the maximum number of second distribution chambers 11' is preferably 2 (in which case the distribution chambers 11 and 11' are disposed at 3 levels). The depth of phosphating solution in each second distribution chamber 11' is preferably the same as the above-described preferred depth of the phosphating solution in the first distribution chamber 11.

As shown in FIG. 3, when a second distribution chamber 11' is provided, the distance between the first and second distribution chambers 11 and 11' is preferably fixed, the distance between the upper surface of the solution in the second distribution chamber 11' and the bottom surfaces of the nozzles 4 is made B, and the supply pipe 5 is preferably moved in the vertical direction so as to maintain distance B constant. Distance A is controlled in the same manner as when there is only the first distribution chamber 11.

The shape, size, number, and pattern of the holes formed in the bottom surface of each distribution chamber 11 and 11' are selected such that a phosphating solution can accumulate in each chamber, so that phosphating solution can drop from the holes to form a continuous flow without plugging the holes, and so that a phosphating solution which is dropped from the first distribution chamber 11 can uniformly adhere to the surface of a pipe being treated. The holes are normally circular, and they are preferably provided in a uniform pattern over substantially the entire of the bottom surface of the distribution chamber in which they are formed. Thus, the bottom surface of each distribution chamber can be formed from a perforated plate.

From the standpoint of preventing uneven dropping, the diameter of the holes is preferably as small as possible within a range which will not cause plugging of the holes, and it is desirable to have a large number of holes. When performing phosphate treatment for steel pipes having different outer diameters, an example of a suitable number of the holes in the bottom surface of the first distribution chamber 11 is at least 144 holes (such as 12 holes per row×12 rows) per an area of the bottom surface measuring (D×D) $mm^2$, wherein D (mm) is the outer diameter of the smallest-diameter pipe which is to be treated.

The diameter of the holes in the first distribution chamber 11 is sufficient to allow the treatment liquid to drop through the holes in the form of a continuous, laminar flow without plugging the holes. In the case of a phosphating solution, the diameter of the holes is preferably at least 3 mm. Also, it is preferably at most 5 mm so that the phosphating solution which is dropped from the holes does not enter a state of nonlaminar flow and so that the capacity of the pump which supplies the phosphating solution from a tank to the nozzles 4 need not be too big. If uneven treatment occurs when the phosphating solution is dropped from the first distribution chamber 11, the unevenness can be reduced or eliminated by providing one or more second distribution chamber 11' above the first distribution chamber 11. The diameter of the holes in the second distribution chamber 11' is preferably the same as that of the holes in the first distribution chamber 11, or slightly larger (with a corresponding decrease in the number of holes).

As stated earlier, the phosphating solution 2 which is introduced from the nozzles 4 is previously heated by a heating mechanism provided in the tank or between the tank and the nozzles 4 so that it will be at a prescribed temperature when it contacts the pipes 3 to be treated. If necessary, a thermostat-controlled heating device and/or a stirring device can be installed on one or both of the first and second distribution chambers 11 and 11' to reduce or eliminate a decrease in the temperature or nonuniformity of the phosphating solution retained in the distribution chambers.

As shown in FIG. 3, in order to prevent the holes in the distribution chambers from becoming plugged and to suppress uneven dropping of the phosphating solution, a screen 12 or other filtering device having openings smaller than the holes in the bottoms of the distribution chambers may be disposed above at least one of the first and second distribution chambers and preferably above at least the uppermost distribution chamber. A screen 12 is effective to prevent plugging of the holes in the distribution chambers particularly when the phosphate surface treatment is recirculated and there is the possibility of sludge being present in the phosphating solution.

The distribution chambers 11 and 11' and the screen 12 are preferably made of a material (such as stainless steel) which is resistant to the phosphating solution.

According to the present invention, by performing phosphate treatment on the outer peripheral surface of the end of a pipe by a laminar flow of a phosphating solution which is formed by allowing the solution to naturally fall through holes formed in the bottom of a distribution chamber having a large bottom area, a large number of pipes can be uniformly and efficiently treated. In addition, by dropping a phosphating solution to a steel pipe from a constant height which is not so far from the top of the pipe, variation in the dropping speed of the phosphating solution onto the pipe and a decrease in the temperature of the solution are suppressed, a chemical reaction during surface treatment is promoted, and a surface treatment coating having a large coating weight and a uniform thickness can be obtained. By having distribution chambers disposed at two or more levels, uneven treatment can be further suppressed.

The method of the present invention makes it possible to form a uniform phosphate coating on a threaded connecting portion of a steel pipe for use as an oil well pipe. As a result, the occurrence of galling due to inadequate lubrication, such as is observed when tightening oil well pipes having a lubricating oil or grease applied to a phosphate coating with variations in thickness, can be prevented.

EXAMPLE

In order to illustrate the effects of a surface treatment method for steel pipes according to the present invention, the following experiments were performed.

Figure 4:
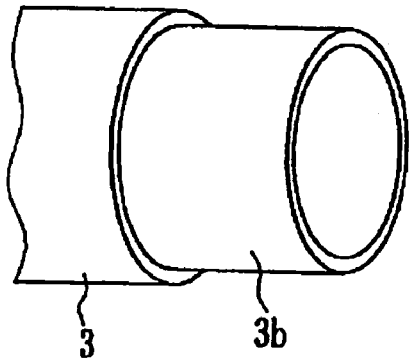
FIG. 4 is a perspective view of the end of a pipe used in an example for testing.

Tests were performed on test pipes which were API 5CT P110 Grade steel pipes (having a chemical composition, in mass %, of C: 0.2-0.3%, Si: 0.3%, Mn: 1.3%, Cr: 0.5%, and a remainder of Fe and unavoidable impurities) having an outer diameter of 177.80 mm and a wall thickness of 10.51 mm. As shown in FIG. 4, the end of each pipe was finished by machining over a length of approximately 150 mm from the end of the pipe to give the pipe a uniform inner and outer diameter and to obtain an average surface roughness Ra of 1.3 μm on the inner and outer surface. Threads were not formed on the ends of the pipe so that lack of hiding in a phosphate coating formed thereon could be more easily ascertained by visual observation and so that the coating weight could be more easily measured.

The finished end portions of the test pipes were subjected to phosphate treatment by the method according to the present invention using one distribution chamber as shown in FIGS. 1(*a*) and 1(*b*) (referred to below as the one-level method) or two distribution chambers as shown in FIG. 3 (referred to below as the two-level method) (without rotation of the test pipe in these methods), or by the conventional method shown in FIGS. 8(*a*) and 8(*b*) (employing direct spraying from nozzles). The phosphating solution was a commercially available zinc phosphating solution which was diluted with water according to the manufacturer's specifications and heated in a tank to 70±5° C. Ten pipes at a time were subjected to phosphate treatment, and the phosphate coating formed on the finished end portions of the pipes was evaluated with respect to coating weight and lack of hiding.

Figure 8:
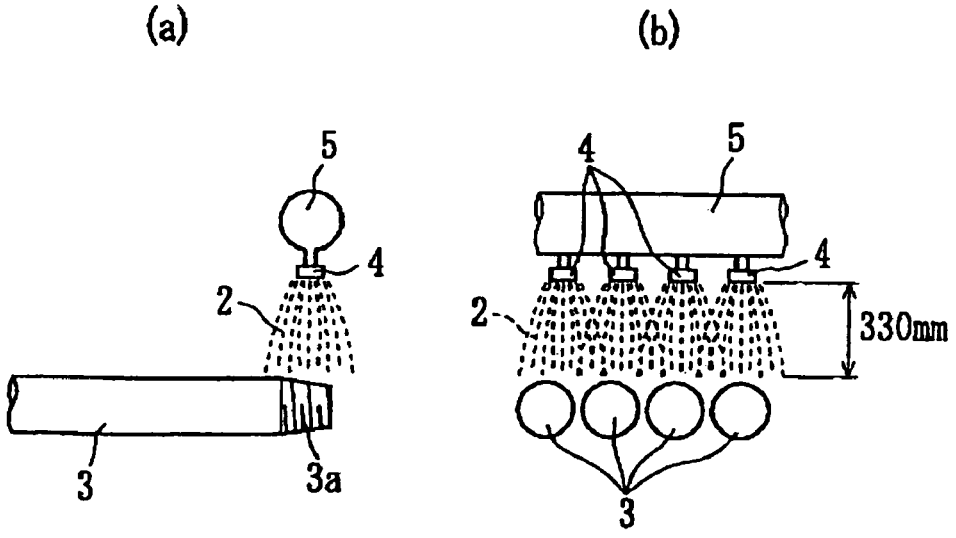
PRIOR ART Fig. 8
FIG. 8(*a*) is a schematic side elevation and FIG. 8(*b*) is a schematic front elevation of pipes undergoing surface treatment by the conventional dropping method.

For the conventional method shown in FIGS. 8(*a*) and (*b*), the distance in the horizontal direction between adjacent nozzles 4 installed on the supply pipe 5 was set to 150 mm, and the height from the bottom surfaces (the tips) of the nozzles 4 to the ends of the steel pipes 3 was set at 330 mm.

Figure 5:
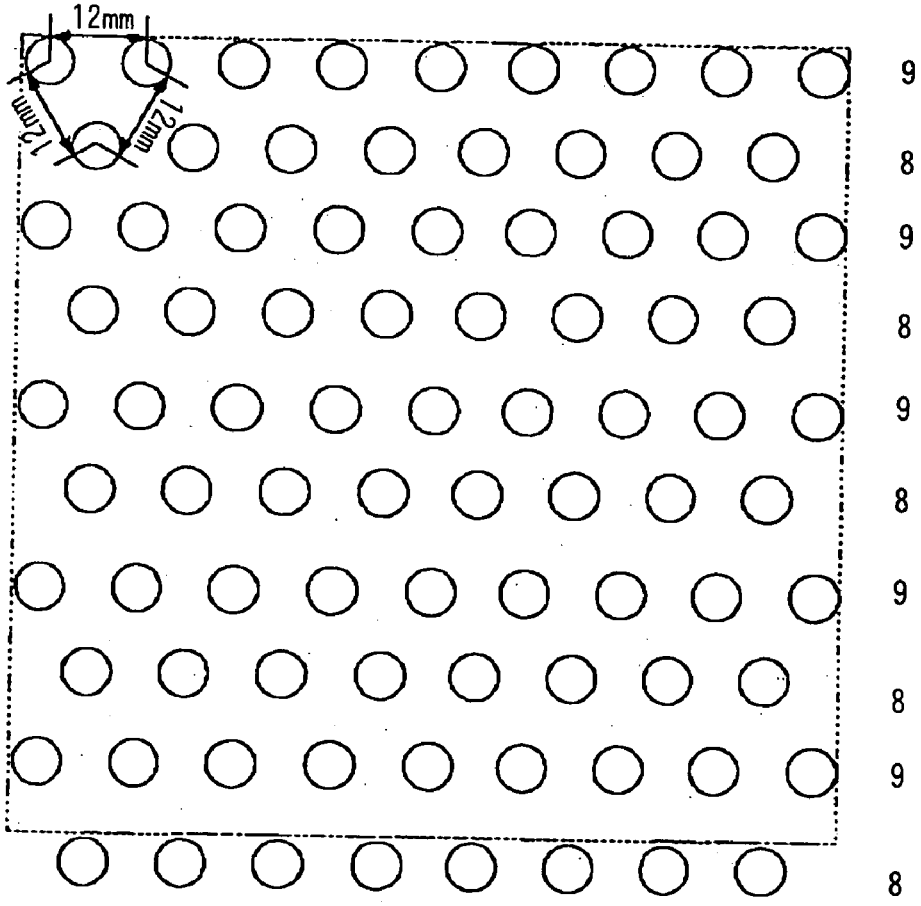
FIG. 5 is a plan view showing the pattern of holes formed in the bottom surface of the distribution chambers used in the example.

In the method according to the present invention shown in FIGS. 1(*a*) and 1(*b*) and FIG. 3, a distribution chamber measuring 2800 mm long×300 mm wide×80 mm tall was used, the distribution chamber being disposed such that its 300 mm-width was parallel to the axial direction of the pipes being treated. In the two-level method shown in FIG. 3, two such distribution chambers were used. Each distribution chamber had a flat bottom surface. As shown in FIG. 5, the holes each had a diameter of 4 mm and were arranged in a staggered pattern such that the center-to-center pitch between any two adjoining holes was 12 mm. The number of holes in the pattern was such that there were 76 or 77 (an average of 76.5) holes in an area of the bottom surface measuring 100 mm×100 mm. The distance A between the bottom surface of the first distribution chamber 11 and the ends of the pipes 3 being treated was varied as shown in the following table by raising and lowering the distribution chambers. The supply pipe 5 was raised and lowered by the same amount to maintain the distance B between the bottom surface of the nozzles 4 and the top surface of the solution in the first distribution chamber 11 (in the 1-level method) or the second distribution chamber 11' (in the two-level method) constant at 100 mm. In the two-level method, the distance between the bottom surface of the second distribution chamber 11' and the top surface of the solution in the first distribution chamber 11 was 85 mm.

The conditions other than those described above were the same for each method. The test results and the height A of the first distribution chamber 11 (the distance A between the bottom surface of the first distribution chamber 11 and the ends of the steel pipes) are summarized in Table 1 below.

In the table, lack of hiding of the phosphate coating was evaluated as follows:

×: occurrence of lack of hiding in which the bare steel could be seen (a problem exists in actual use)

○: the bare steel could not be seen, but some unevenness of the phosphate coating could be observed (substantially no problem in actual use)

⊙: no unevenness at all in the phosphate coating

Figure 6:
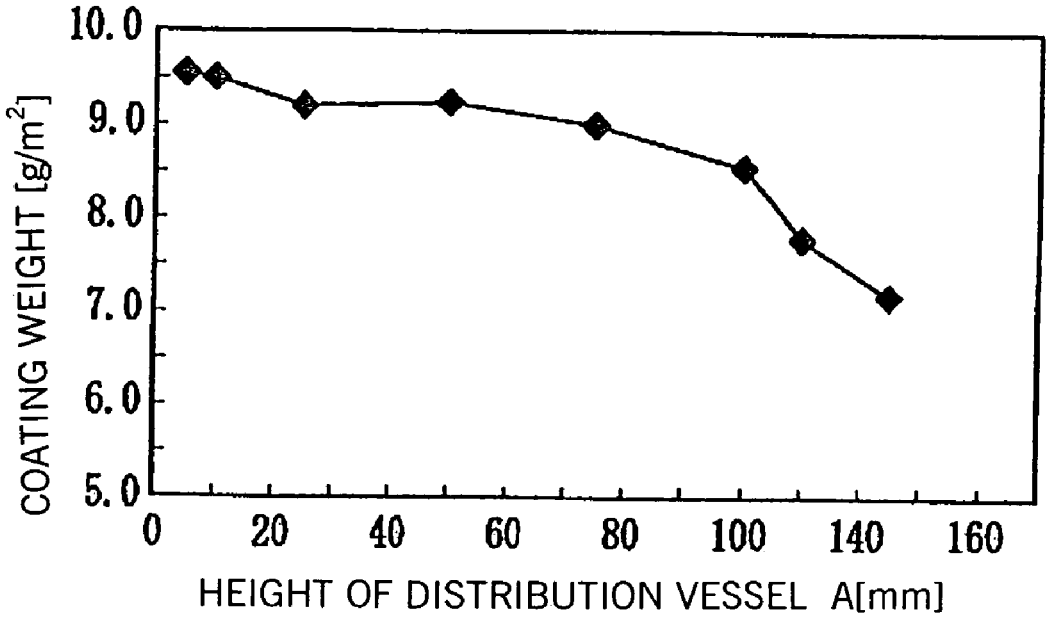
FIGS. 6(*a*) and 6(*b*) are graphs showing the results of the example performed using a single distribution chamber and two distribution chambers at different levels, respectively.
Figure 6:
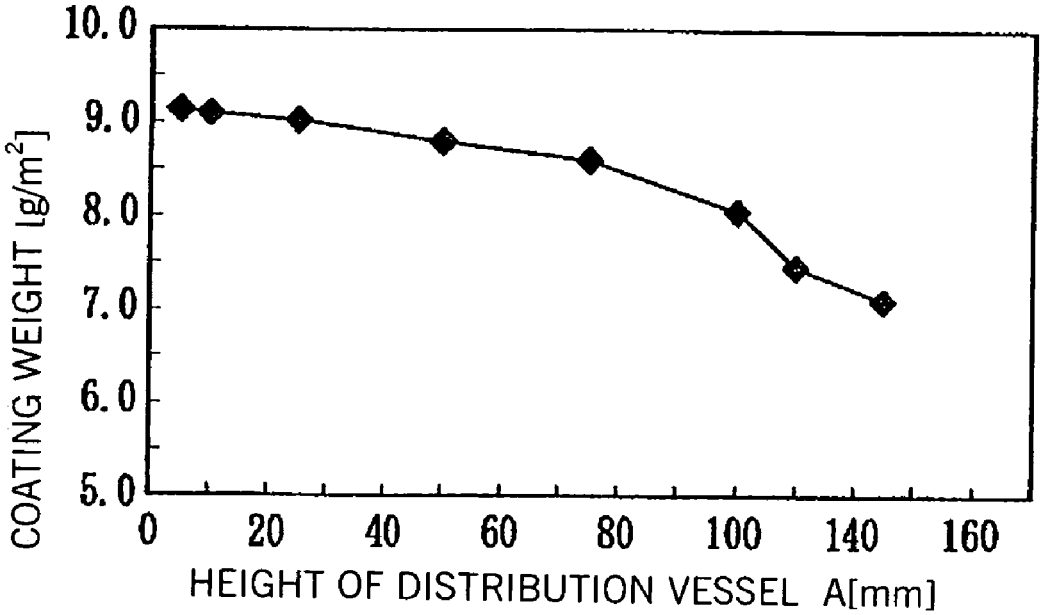
Figure 7:
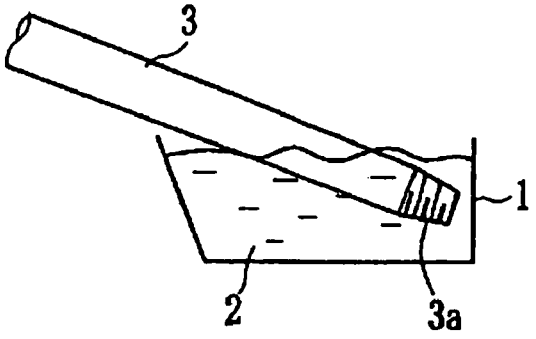
FIG. 7 is a schematic side elevation of a pipe undergoing phosphate treatment by the conventional immersion method.

FIGS. 6(*a*) and 6(*b*) are graphs showing the relationship between the height A of the first distribution chamber 11 and the coating weight of the phosphate coating for the one-level method and the two-level method, respectively. The coating weight of the phosphate coating is preferably at least 8 g/m$^2$ in order to impart sufficient lubricity to a threaded joint of an oil well pipe.

As is clear from the table, with the conventional dropping method shown in FIGS. 8(*a*), 8(*b*), lack of hiding of the phosphate coating in which the bare steel was visible occurred, and the coating weight was much smaller than the desired value of 8 g/m$^2$. This is thought to be because the adhesion of the phosphating solution was uneven, and the decrease in temperature during dropping was large.

In contrast, with the method according to the present invention, lack of hiding of the phosphate coating was suppressed, and the coating weight was extremely large. However, when the distance A was greater than 100 mm, as shown in the table and FIGS. 6(*a*) and (*b*), the coating weight decreased to somewhat below the desired value of 8 g/m$^2$. With the two-level method, the coating weight of the phosphate coating was somewhat smaller than for the one-level method, but it was superior form the standpoint of preventing lack of hiding.

TABLE 1

| Category | Number of distribution chambers | Height A of distribution chamber (mm) | Coating weight (g/m$^2$) | Lack of hiding |
|---|---|---|---|---|
| Conventional method | — | — | 5.77 | X |
| This invention | 1 level | 5 | 9.52 | ○ |
| | | 10 | 9.50 | ○ |
| | | 25 | 9.20 | ○ |
| | | 50 | 9.23 | ○ |
| | | 75 | 9.01 | ○ |
| | | 100 | 8.56 | ○ |
| | | 110 | 7.80 | ○ |
| | | 125 | 7.20 | ○ |
| | 2 levels | 5 | 9.11 | ⊙ |
| | | 10 | 9.08 | ⊙ |
| | | 25 | 9.01 | ⊙ |
| | | 50 | 8.77 | ⊙ |
| | | 75 | 8.56 | ⊙ |
| | | 100 | 8.01 | ⊙ |
| | | 110 | 7.40 | ⊙ |
| | | 125 | 7.05 | ⊙ |

The invention claimed is:

1. A method for surface treatment of at least a portion of the outer peripheral surface of a metal pipe, comprising:

introducing a treatment liquid into a second distribution chamber having a flat bottom surface, and introducing the treatment liquid into a first distribution chamber through holes formed in the bottom surface of the second distribution chamber, the first distribution chamber having a flat bottom surface, and then dropping the treatment liquid onto at least a portion of the outer peripheral surface of a metal pipe through holes formed in the bottom surface of the first distribution chamber, the treatment liquid flowing in a downward direction when dropped from a respective hole in the bottom surface, the metal pipe further comprising a steel pipe having a threaded connecting portion formed on the exterior of at least one of its ends, and wherein the threaded connecting portion is the portion of the metal pipe which is subjected to surface treatment.

2. A method as claimed in claim 1 including maintaining a distance between the bottom surface of the first distribution chamber and the metal pipe constant as the outer diameter of the pipe varies.

3. A method as claimed in claim 2 including maintaining the distance constant in a range of 5 -100 mm.

4. A method as claimed in claim 2 including maintaining the distance constant by varying a height of the first distribution chamber in accordance with the outer diameter of the metal pipe.

5. A method as claimed in claim 1 including introducing the treatment liquid into the first distribution chamber from one or more nozzles mounted on a supply pipe.

6. A method as claimed in claim 5 including maintaining a distance between a bottom surface of the nozzles and a top surface of the treatment liquid in the first distribution chamber constant.

7. A method as claimed in claim 1 including introducing the treatment liquid into the second distribution chamber from one or more nozzles mounted on a supply pipe.

8. A method as claimed in claim 7 including maintaining a distance between a bottom surface of the nozzles and a top surface of the treatment liquid in the second distribution chamber constant.

9. A method as claimed in claim 6 including maintaining the distance between the bottom surface of the nozzles and the top surface of the treatment liquid in the distribution chamber constant by raising and lowering the nozzles.

10. A method as claimed in claim 1 including simultaneously dropping the treatment liquid from the first distribution chamber onto at least two metal pipes.

11. A method as claimed in claim 1 including introducing the treatment liquid into the first distribution chamber such that the treatment liquid accumulates in the first distribution chamber to a depth of 10 -20 mm.

12. A method as claimed in claim 1 wherein the surface treatment is phosphate chemical conversion treatment.

13. A method as claimed in claim 12, wherein the diameter of the holes in the bottom surface of the first distribution chamber is 3 -5 mm.

14. A method as claimed in claim 13 wherein a plurality of pipes having different outer diameters are subjected to surface treatment, and the bottom surface of the first distribution chamber has at least 144 holes in an area measuring D X D $mm^2$, wherein D (mm) is the outer diameter of the smallest metal pipe to be treated.

15. A method as claimed in claim 1, wherein substantially all of the treatment liquid is supplied to the distribution chamber.

16. A method as claimed in claim 1, wherein the distribution chamber extends along an axis of the pipe to be treated and the treatment liquid is dropped along said axis during said treatment.

* * * * *